US007410068B1

(12) United States Patent
Andreetto

(10) Patent No.: US 7,410,068 B1
(45) Date of Patent: Aug. 12, 2008

(54) BLONDIN CABLEWAY INSTALLATION

(75) Inventor: Alessandro Andreetto, Bressanone (IT)

(73) Assignee: Agudio S.p.A., Leini (IT)

( * ) Notice: Subject to any disclaimer, the term of this patent is extended or adjusted under 35 U.S.C. 154(b) by 0 days.

(21) Appl. No.: 11/774,008

(22) Filed: Jul. 6, 2007

(51) Int. Cl.
*B66C 21/08* (2006.01)

(52) U.S. Cl. ..... 212/94; 104/116; 104/182; 212/121

(58) Field of Classification Search ..... 212/94, 212/95, 121; 104/116, 182
See application file for complete search history.

(56) References Cited

U.S. PATENT DOCUMENTS

| | | | | | |
|---|---|---|---|---|---|
| 715,471 | A * | 12/1902 | French | 212/94 |
| 1,057,660 | A * | 4/1913 | Norris | 212/121 |
| 1,501,748 | A * | 7/1924 | Chapman et al. | 104/182 |
| 1,934,478 | A * | 11/1933 | Bateman | 212/94 |
| 2,547,935 | A * | 4/1951 | Grabinski | 105/155 |
| 3,079,131 | A * | 2/1963 | Naud | 254/415 |
| 3,083,839 | A * | 4/1963 | McIntyre | 212/87 |
| 3,396,853 | A | 8/1968 | Dettoni | |
| 4,103,784 | A * | 8/1978 | Gonsior | 212/94 |
| 4,347,938 | A * | 9/1982 | Gorsh | 212/121 |
| 4,355,727 | A * | 10/1982 | Biller | 212/121 |
| 6,196,402 | B1 * | 3/2001 | Staats | 212/91 |

* cited by examiner

*Primary Examiner*—Thomas J. Brahan
(74) *Attorney, Agent, or Firm*—Sughrue Mion, PLLC

(57) ABSTRACT

A blondin cableway installation, comprises a pair of carrying cables extending between the two ends of the installation; a carriage provided with a lifting tackle and supported movably on the carrying cables; a lifting cable for operating the lifting tackle, extending between the two ends of the installation; an outward haulage cable for conveying the carriage along the pair of carrying cables, said outward haulage cable being connected via tackle to the carriage so as to have a pair of outward haulage sections which extend between the carriage and each end of the installation; and a plurality of cradles arranged along the pair of carrying cables and suspended from them in a stationary manner and designed to support the lifting cable and outward haulage cable, each of the cradles comprising, on each side, a pair of support rollers able to receive by means of gravity, alternately, the outward haulage cable or the lifting cable, and a corresponding pair of retaining rollers able to bias the lifting cable and haulage cable against the support rollers, the retaining rollers being supported by a pendulum member hinged with the cradle; wherein the carriage has, formed in it, a longitudinal passage which has a cross-section such as to allow it to be passed through by one of the cradles during the movement of the carriage; and wherein the carriage is provided, on each side of the passage, with a cam member able to raise the retaining rollers upon entry of the passage by the cradle, so as to allow disengagement of the lifting cable and outward haulage cable from the support rollers when the carriage is passed through by the cradle, the cam member acting on a respective tappet member integral with the pendulum member.

5 Claims, 9 Drawing Sheets

BLONDIN CABLEWAY INSTALLATION

The present invention relates to a blondin cableway installation (also known as cable crane). As is known, installations of this type are used for transporting material in particular during the construction of dams or viaducts, for use in large open-air depots, or in shipyards.

BACKGROUND OF THE INVENTION

A blondin installation consists essentially of a carriage which moves along a carrying cable laid between two ends. The carriage is moved by a haulage cable wound endlessly between these ends. The carriage has, fixed to it, a lifting cable which is deviated to a hook situated underneath the carriage by means of pulleys. The haulage cable and the lifting cable are moved by respective independent winches.

An installation of this type is known from U.S. Pat. No. 3,396,853, which is incorporated herein by way of reference in its entirety. As is known, the lifting and haulage cables may have variable degrees of tension during operation. The tension of the lifting cable in particular may have very low values during operation, when the hook is under no load.

Consequently it is necessary to insert along the carrying cable a certain number of cradles which act as a support for the haulage cable and the lifting cable, so as to prevent them from being subject to excessive sagging which would prevent correct operation of the system. The U.S. Pat. No. 3,396,853 cited above relates to a system where cradles are fixed to a carrying cable and keep the service cables uniformly spaced from each other and, when they are passed through by the carriage, may be traveled over by this carriage without resulting in any interference. This is achieved in that the carriage has a structure with a passage having dimensions such as to allow the cradle to pass through it and in that the distances from the point where the carriage rests on the carrying cable to the respective points where the outward haulage cable and lifting cable are housed inside the carriage are smaller than the corresponding distances on the cradle. In this way, the travel movement of the carriage when passing over a cradle causes raising of the outward haulage cable and the lifting cable by the rollers provided on the cradle.

The object of the present invention is to provide a blondin cableway installation which allows the teaching described above to be applied to a system which uses a haulage cable connected via tackle.

SUMMARY OF THE INVENTION

This object is achieved according to the invention by a blondin cableway installation, comprising at least one carrying cable extending between the two ends of the installation, a carriage provided with a lifting tackle and supported movably on said carrying cable, a lifting cable for operating said lifting tackle, extending between the two ends of the installation, an outward haulage cable for conveying said carriage along said carrying cable, said outward haulage cable being connected via tackle to said carriage so as to have a pair of outward haulage sections which extend between said carriage and each end of the installation, and a plurality of cradles arranged along said carrying cable and suspended from it in a stationary manner and designed to support said lifting cable and outward haulage cable, each of said cradles comprising, on each side, a pair of support rollers able to receive by means of gravity, alternately, said outward haulage cable or said lifting cable, and a corresponding pair of retaining rollers able to bias said lifting cable and haulage cable against said support rollers, said retaining rollers being supported by a pendulum member hinged with the cradle, wherein said carriage has, formed in it, a longitudinal passage which has a cross-section such as to allow it to be passed through by one of the cradles during the movement of the carriage, and wherein said carriage is provided with a cam member able to raise said retaining rollers upon entry of said passage by the cradle, so as to allow disengagement of said lifting cable and outward haulage cable from said support rollers when the carriage is passed through by the cradle, said cam member acting on a tappet member integral with said pendulum member.

Preferred embodiments of the invention are defined in the dependent claims.

BRIEF DESCRIPTION OF THE DRAWINGS

A preferred, but non-limiting embodiment of the invention will now be described, with reference to the accompanying drawings, in which.

DETAILED DESCRIPTION OF THE INVENTION

Figure 1:
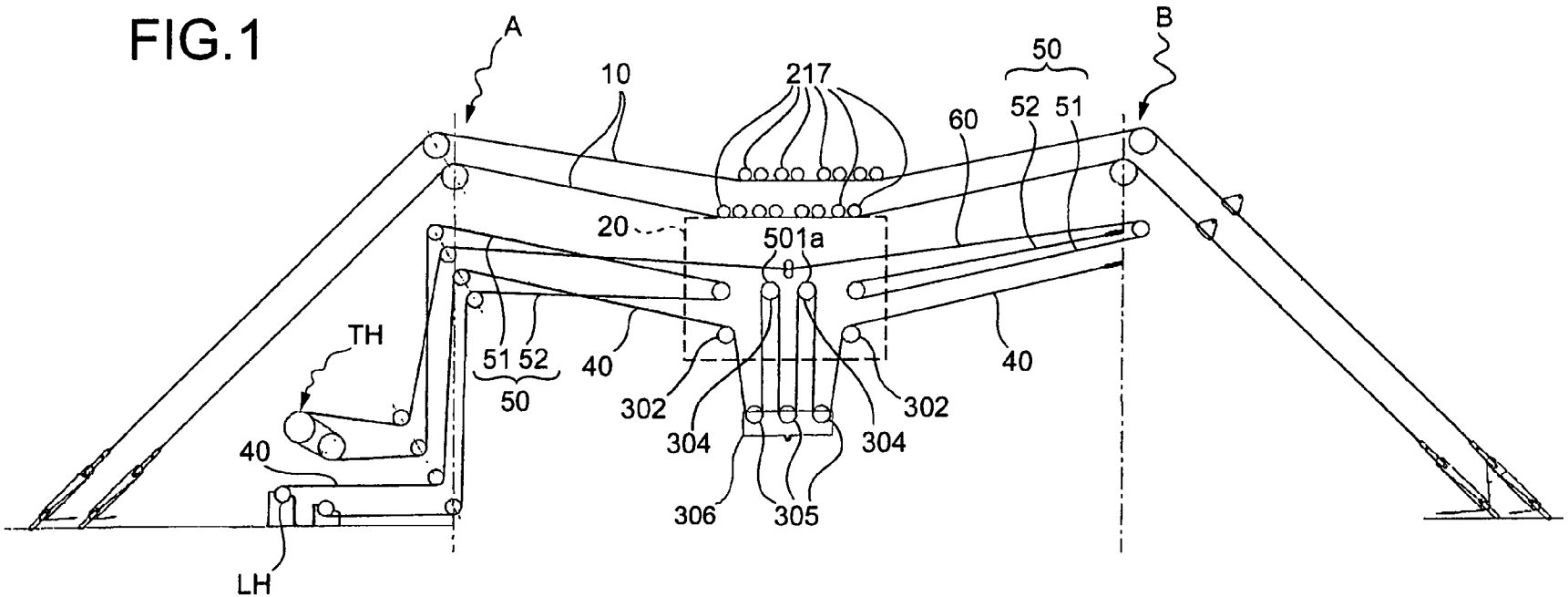
FIG. 1 is a diagram which shows an example of an arrangement of the cables for a blondin cableway installation according to the invention.
Figure 2:
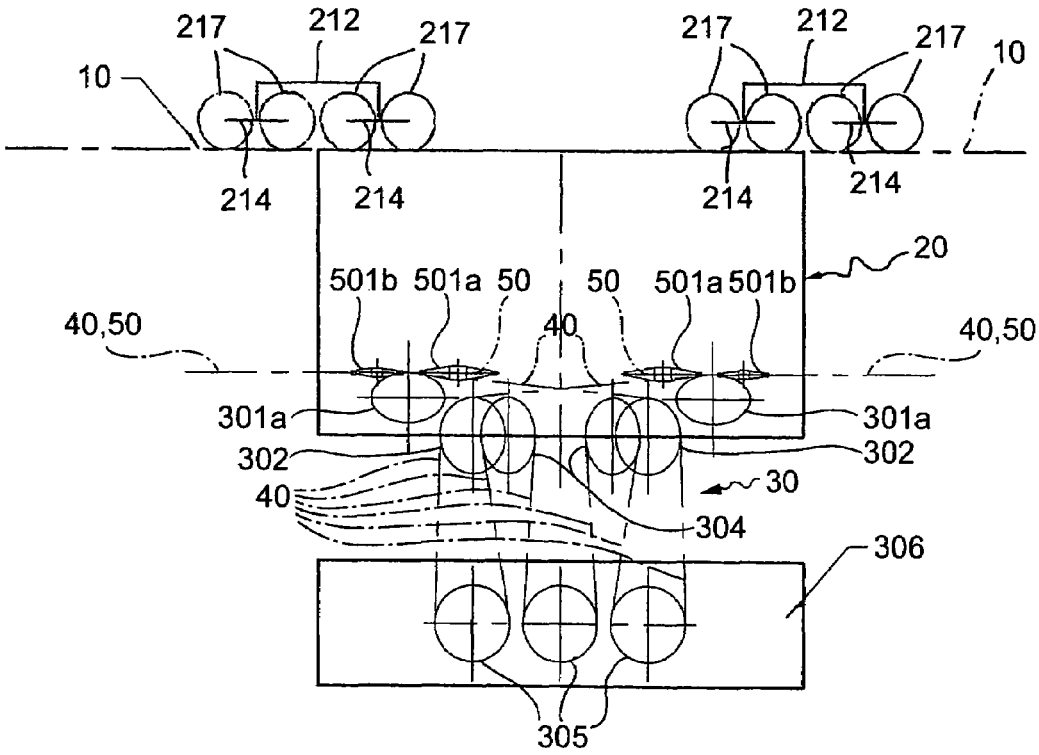
FIG. 2 is a simplified side elevation view which shows a carriage of a blondin cableway installation according to the invention.
Figure 3:
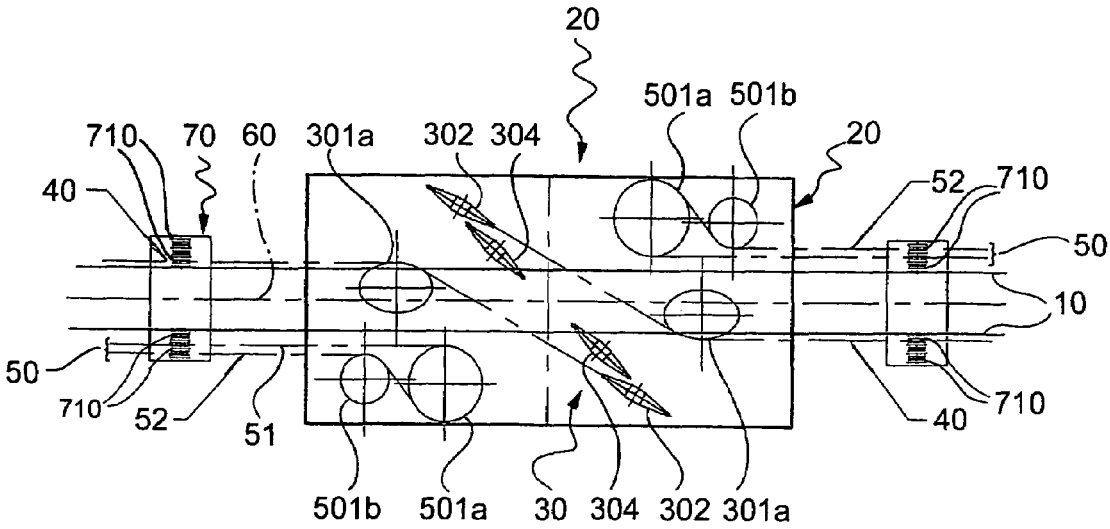
FIG. 3 is a simplified plan view which shows the carriage according to FIG. 2 and two cradles, arranged before and after the carriage, respectively.

FIG. 1 shows an example of an arrangement of the cables for a blondin installation according to the invention, while FIGS. 2 and 3 show in simplified and schematic form, a side elevation view and plan view, respectively, of a carriage and a number of cradles of a blondin installation according to the invention. The installation comprises a pair of carrying cables 10 which extend between the two ends of the installation (indicated by A and B in FIG. 1) and which support a carriage 20 provided with a lifting tackle 30. The carriage is able to move along the carrying cables 10. The number of carrying cables is not critical for the purposes of the invention, the latter also being applicable to a system with a single carrying cable. Below, reference will be made for the sake of simplicity to the sole example comprising a pair of a carrying cables. As can be seen in FIG. 1, the carrying cables 10 are anchored adjustably at their ends. The installation also comprises a lifting cable 40 for operating the lifting tackle 30, which extends between the two ends of the installation. The lifting cable is operated at one end by a winch LH, while at the other end it is anchored to one end of the installation. The installation also comprises a haulage cable for moving the carriage 20, which is operated by a winch TH separate from the lifting winch and extends between the ends of the installation, being deviated several times between these ends. In particular, between the ends of the installation, the haulage cable comprises a part, called outward haulage cable 50, which is connected to the carriage 20 so as to convey it along the pair of carrying cables 10, and a part, called return haulage cable 60 (shown in FIG. 3), which forms the return part of the haulage cable loop between the two ends of the installation. The outward haulage cable 50 is connected via tackle to the carriage 20 so as to have a pair of outward haulage sections 51, 52 which extend between the carriage and each end of the installation. In the example shown in FIG. 1, a first section 52 of the outward haulage cable 50 is at one end anchored adjustably to the end A of the installation and at the other end is deviated, at the carriage 20, to the second section 51 of the outward haulage cable 50, which returns to the end A of the installation where it is wound around the winch TH. From the winch TH the cable is deviated as a return haulage cable 60 to the other end B of the installation. From the end B the cable is again deviated towards the carriage 20 as the section 51 of the outward haulage cable 50. At the carriage 20, this section 51 is deviated to the other section 52 of the outward haulage cable 50, towards the end B of the installation to which the section 52 is anchored. The arrangement described hitherto is provided purely by way of illustration and is not essential for the purposes of the invention.

A plurality of cradles 70 is arranged along the pair of carrying cables 10, two of said cradles being shown in FIG. 3. The cradles 70 are suspended in a stationary manner from the carrying cables 10 and are designed to support the lifting cable 40, the return haulage cable 60 and the outward haulage cable 50, or more precisely, its two outward haulage sections 51, 52. In the case where only one carrying cable is envisaged, the system also comprises a stabilization cable for positioning the cradles, as described in U.S. Pat. No. 3,396,853.

Figure 4:
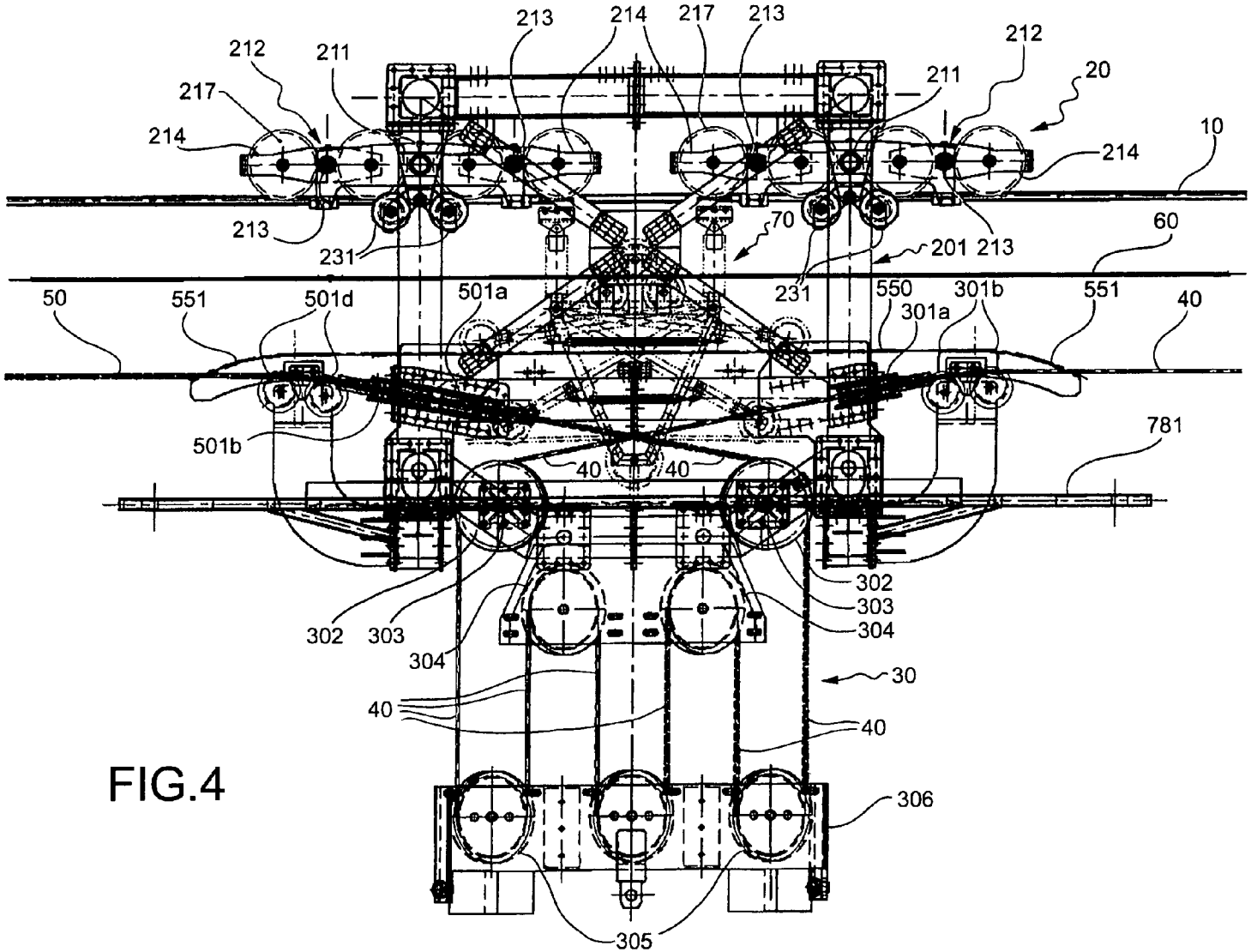
FIG. 4 is a detailed side elevation view which shows a carriage of a blondin cableway installation according to the invention, at the moment when it is passed through by a cradle.
Figure 5:
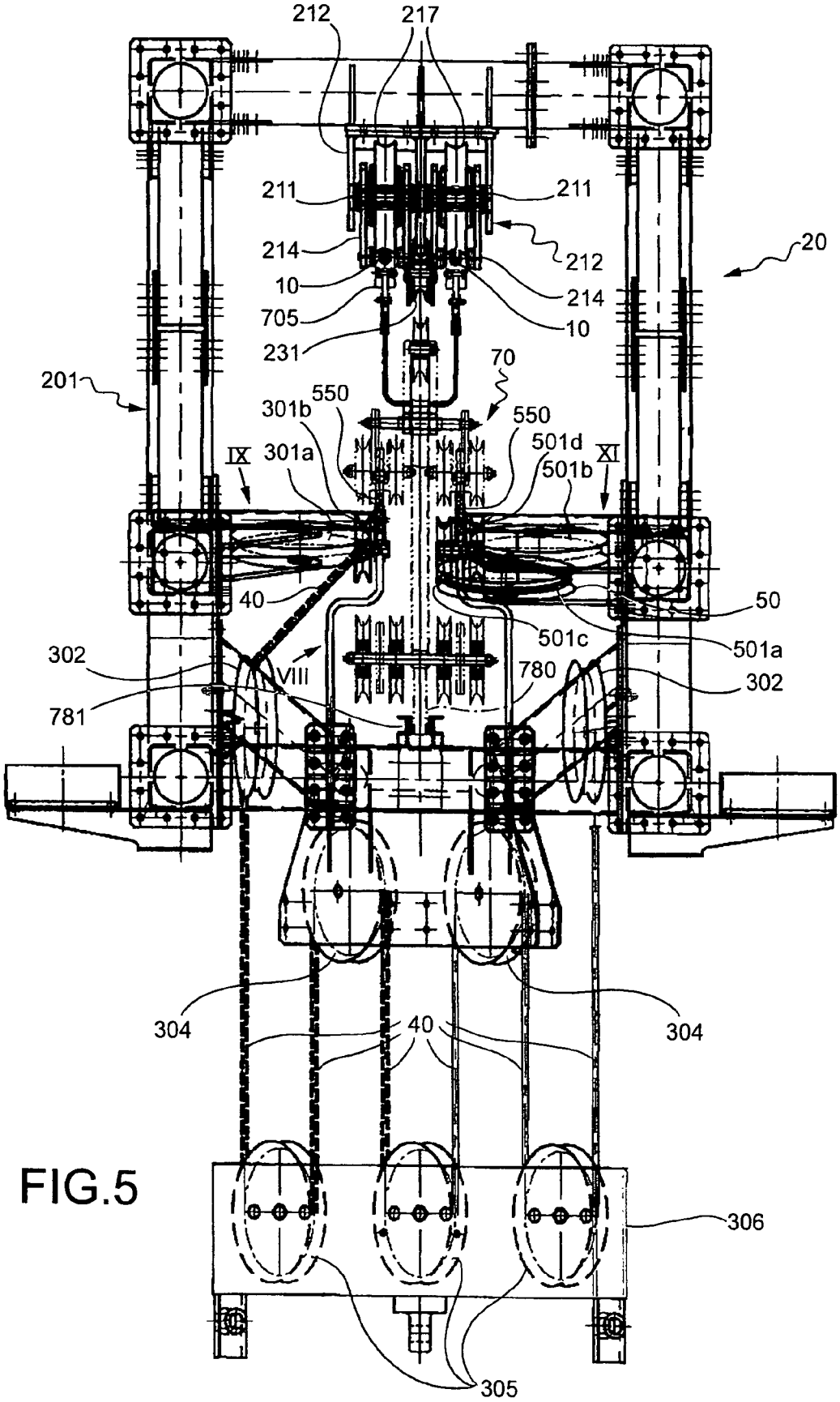
FIG. 5 is a front view which shows the carriage according to FIG. 4.

With reference to FIGS. 4 and 5, the carriage 20 is now described in more detail. The carriage 20 comprises a frame 201, on which four-roller rocker units 212 are pivotably mounted via pivot pins 211. Two-roller rocker units 214 are mounted, pivotably via pivot pins 213, on each four-roller rocker unit 212. Wheels 217 are mounted, in a freely rotatable manner, on the two-roller rocker units 214. Rollers 231 are also fixed to the frame 201 of the carriage 20, at the axis of each four-roller rocker unit 212, and are designed to engage with the return haulage 60 when the latter tends to move upwards with respect to the carriage 20.

Figure 8:
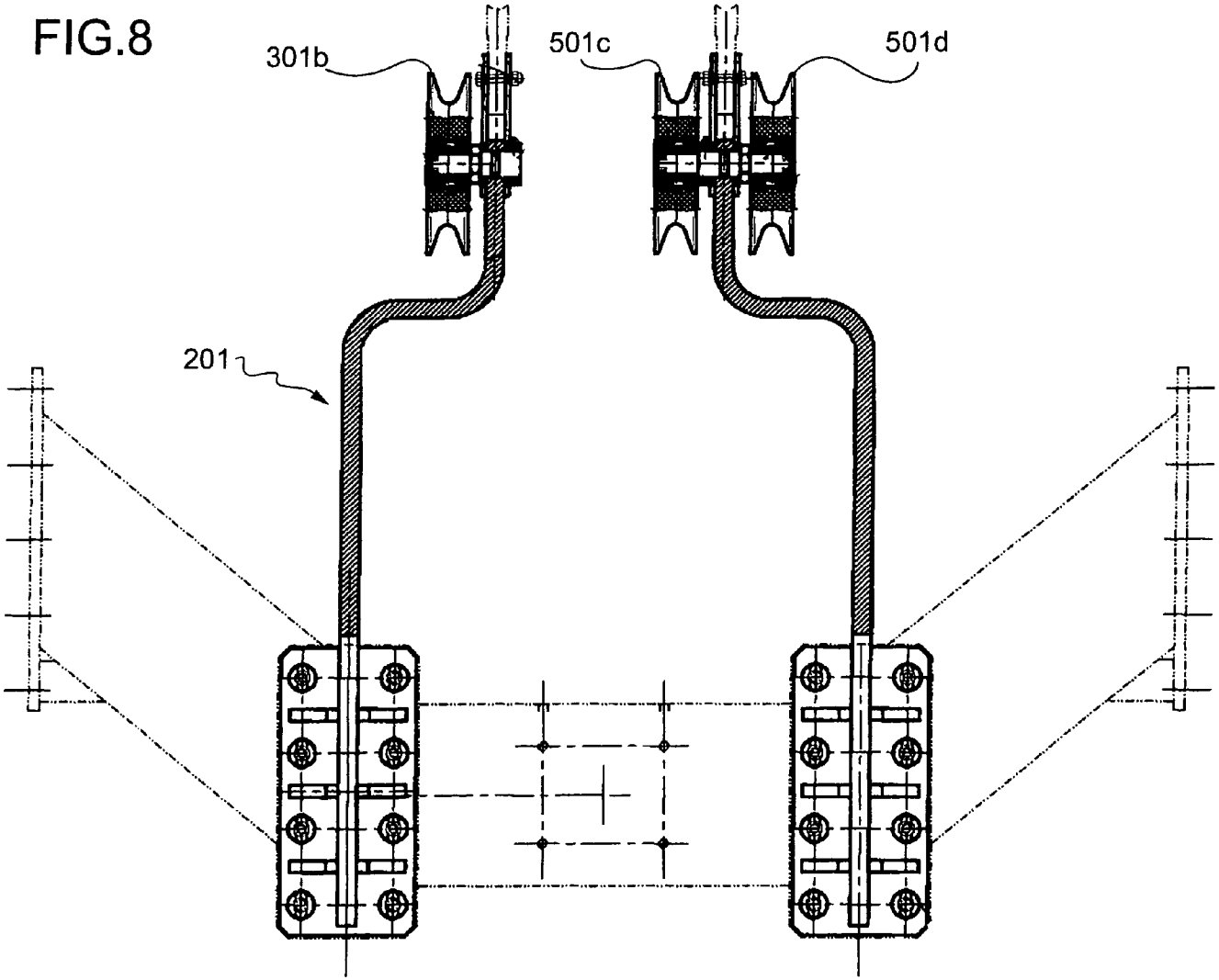
FIG. 8 is a partly sectioned view of a detail of the carriage, indicated by the arrow VIII in FIG. 5.
Figure 10:
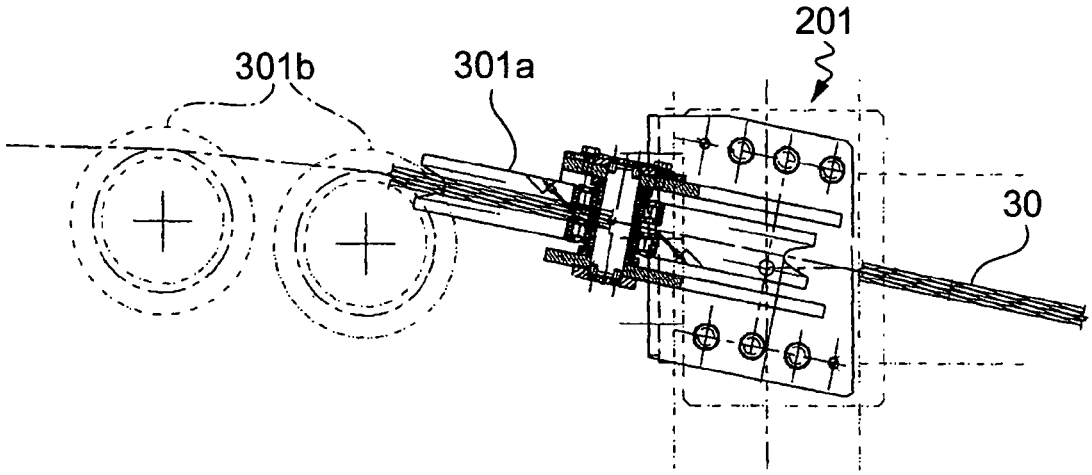
FIG. 10 is a cross-sectional view of the detail according to FIG. 9, along the line X-X.
Figure 9:
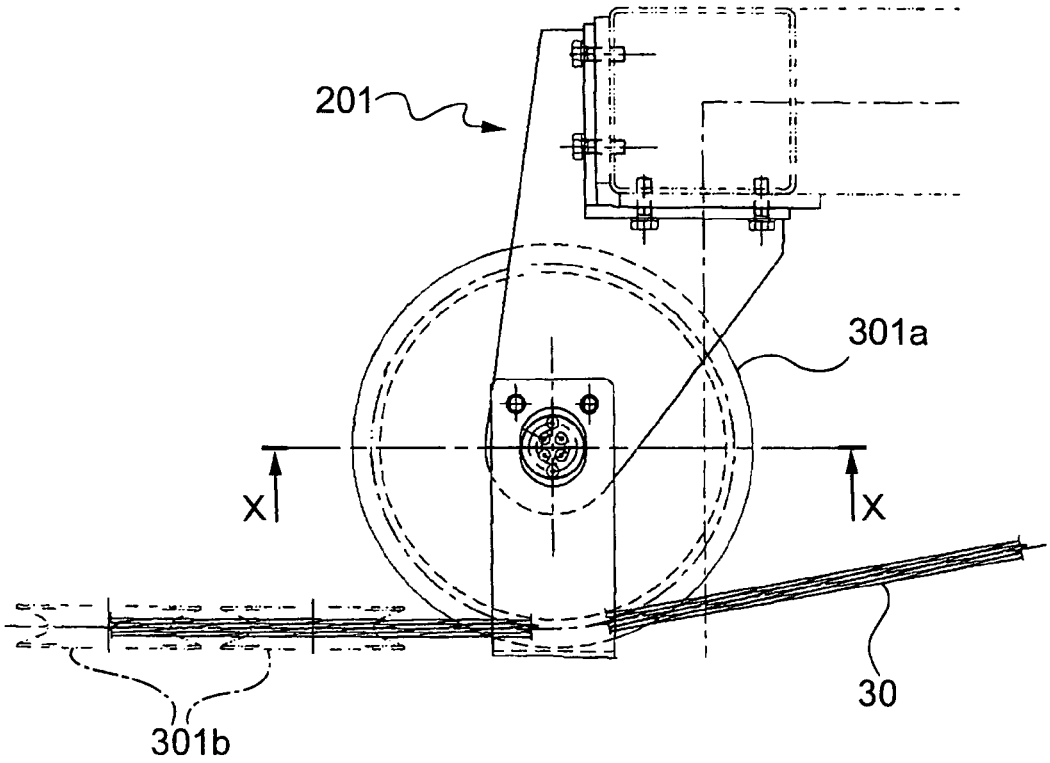
FIG. 9 is a plan view of another detail of the carriage, indicated by the arrow IX in FIG. 5.

The lifting cable 40 is guided to the lifting tackle 30 by means of a series of pulleys 301*a*, 301*b* mounted idle on the frame 201. The pulleys 301*a*, 301*b* are arranged on opposite sides with respect to a middle longitudinal vertical plane of the carriage 20, so that the cable 40 reaches the carriage 20 at points which are laterally staggered at the two longitudinal ends of the carriage 20 as well as at opposite ends of the carriage 20. Reference should be made in this connection also to the detailed views of FIGS. 8, 9 and 10. The pulleys 301*a*, 301*b* deviate the lifting cable 40 to other pulleys 302 of the tackle 30, which are pivotably mounted at points 303 of the frame 201. From the pulleys 302 the lifting cable 40 is deviated to further pulleys, some of which, indicated by 305, are pivotably mounted on a lifting cross-piece 306, suitable for mounting a hook, while others, indicated by 304, are mounted idle on the frame 201. In the example shown, the pulleys 302, 304 and 305 form a six-part tackle. In an alternative solution, not shown here, the pulleys 304 could be mounted on a rocker unit mounted on a ball joint attached to the carriage structure so as to allow an improved alignment of the various pulleys 302, 304 and 305 during the various movements of the carriage.

Figure 12:
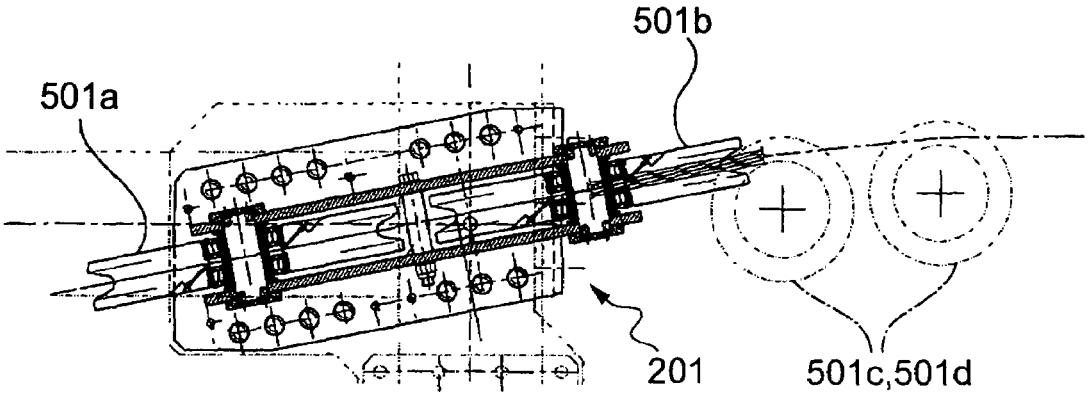
FIG. 12 is a cross-section of the detail according to FIG. 11, along the line XII-XII.
Figure 11:
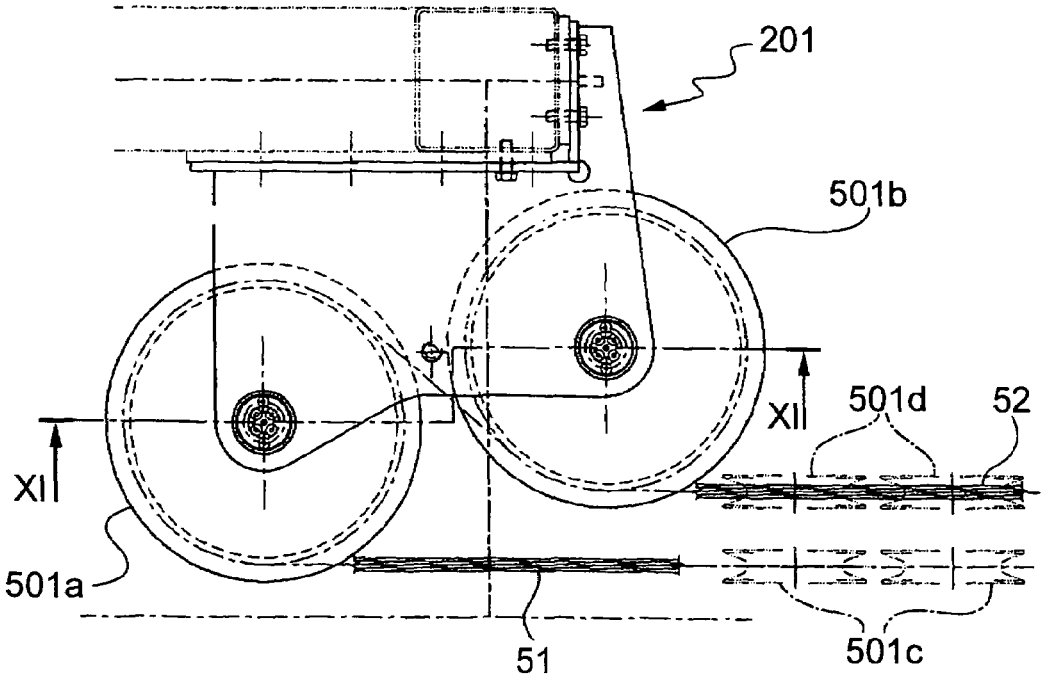
FIG. 11 is a plan view of a further detail of the carriage, indicated by the arrow XI in FIG. 5.

As mentioned above, the outward haulage cable 50 is connected via tackle to the carriage 20 so as to have a pair of outward haulage sections 51, 52 which extend between the carriage and each end of the installation. In particular, from each end of the carriage 20, the haulage cable 50 is wound around a transmission pulley 501*a*, mounted idle on the frame 201, and one of the two sections, indicated by 52, is further deviated by a deviation pulley 501*b*, mounted idle on the frame 201; moreover, both the sections 51 and 52 leaving the carriage 20 rest on respective bearing rollers 501*c*, 501*d*, so that the outward haulage sections thus defined at the ends of the carriage 20 are coplanar and at a predetermined mutual distance, for the reason which will be clarified below. In this connection, reference should also be made to the detailed view of FIGS. 8, 11 and 12. Moreover, the transmission pulleys 501*a* and 501*b*, and the bearing rollers 501*c*, 501*d*, as well as being arranged at opposite ends of the carriage 20, are also arranged on opposite sides with respect to a longitudinal central plane of the carriage 20.

In the carriage 20 the structural parts which form the frame 201 and the various pulleys and rollers mounted in it are arranged so as to form a longitudinal passage—visible in FIG. 5—which has a cross-section such that it can be passed through by one of the cradles 70 during the movement of the carriage 20. Two cam members 550, the function of which will be clarified below, are arranged inside this passage, on opposite sides with respect to the longitudinal middle plane of the carriage 20. These cam members 550 are joined to the frame 201 and have an elongated form, extending in the longitudinal direction of the carriage along the whole longitudinal passage and emerging from this passage with curved ends 551.

Figure 6:
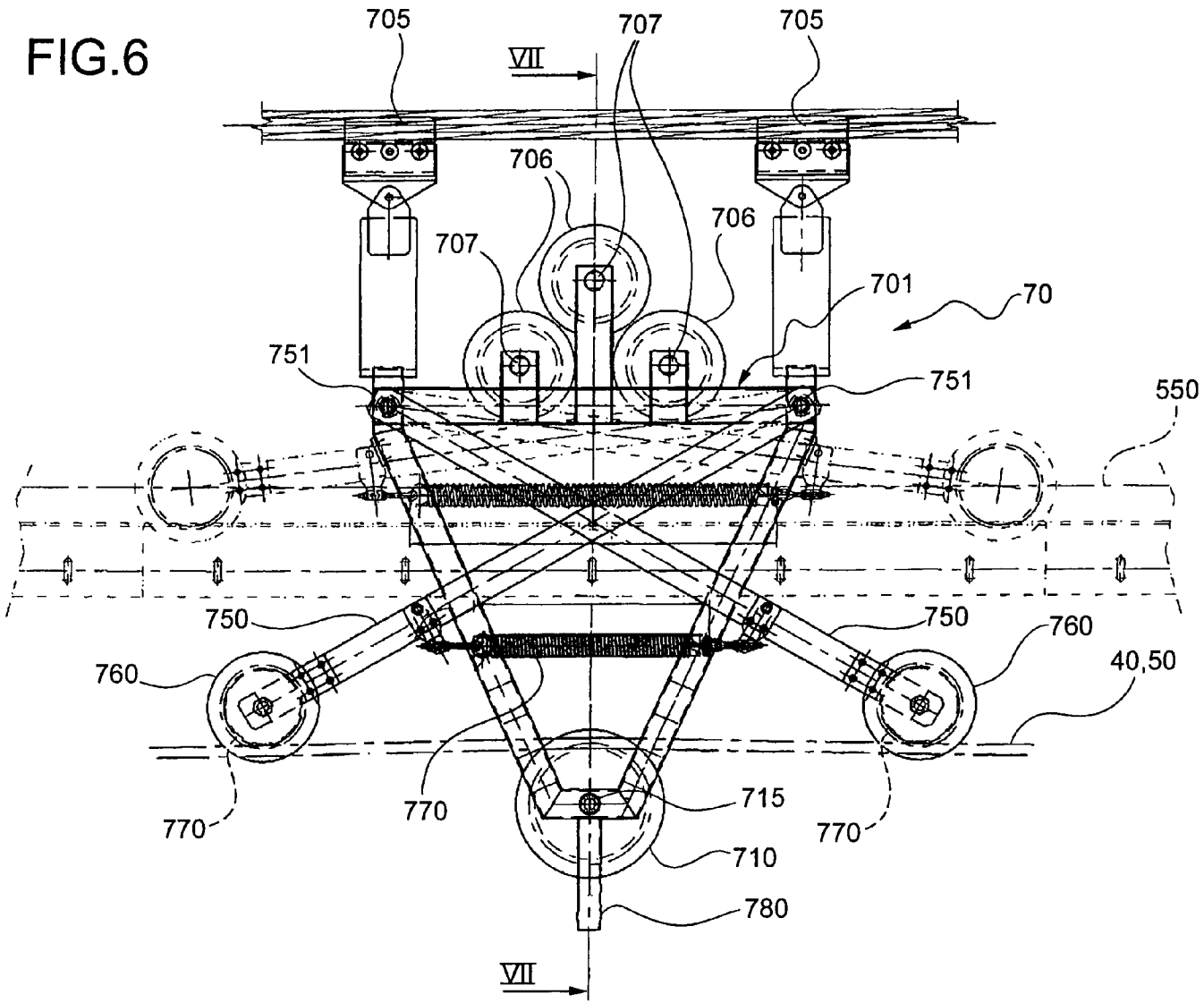
FIG. 6 is a detailed side elevation view which shows the cradle according to FIG. 4.
Figure 7:
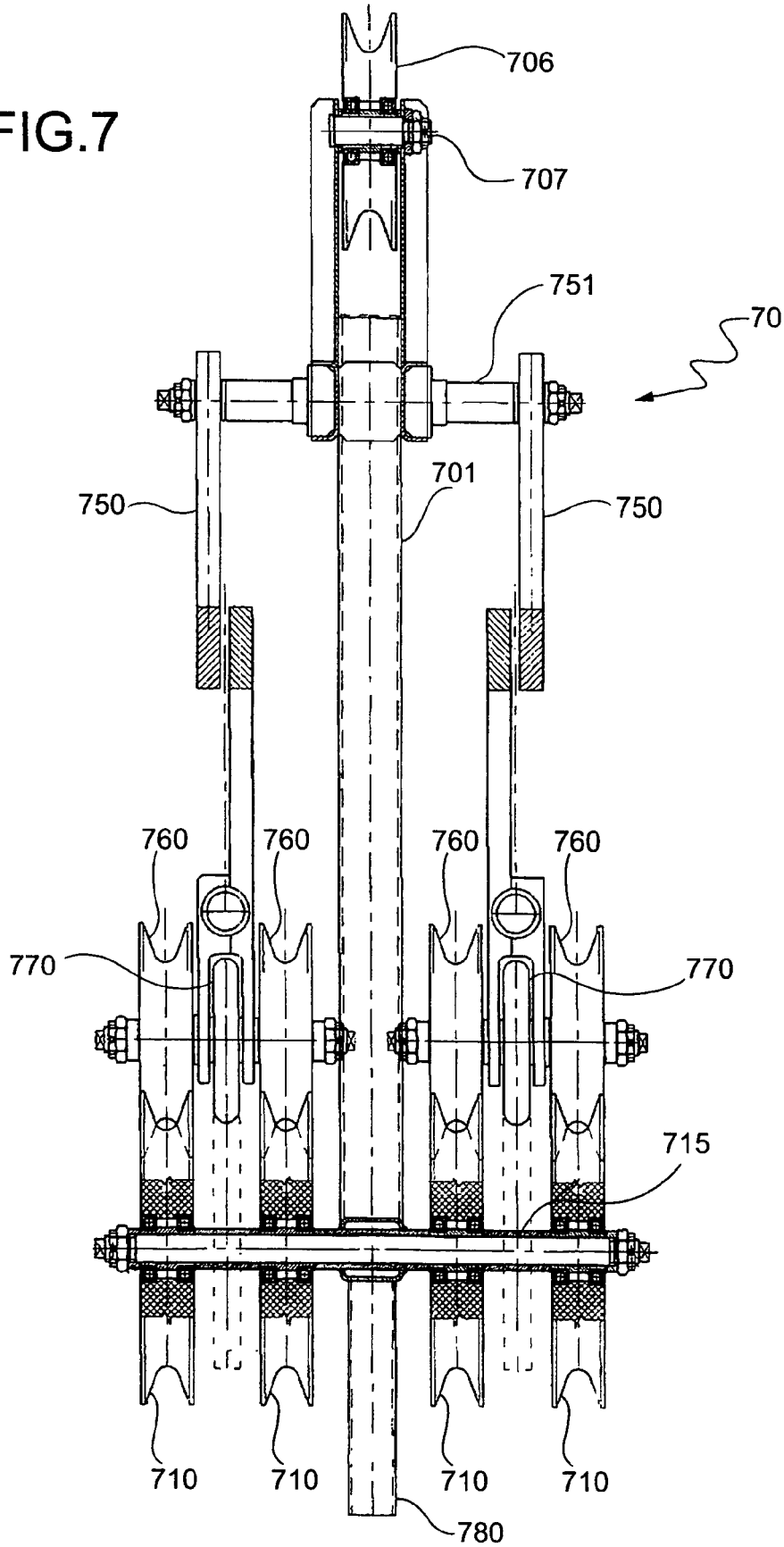
FIG. 7 is a cross-sectional view of the carriage according to FIG. 6, along the line VII-VII.

FIGS. 6 and 7 show in greater detail one of the cradles 70. The cradle 70 has a frame 701 fixed to the carrying cables 10 by means of clamps 705. A group of rollers 706 mounted rotatably via respective pivot pins 707 on the frame 701 of the cradle 70 is provided in a middle position lower than the fixing points of the carrying cables 10. The return haulage cable 60, not shown in FIGS. 6 and 7, is guided between these rollers 706. The rollers 706, being arranged on vertically opposite sides with respect to the return haulage cable 60, provide a guide for this cable. The cradle 70 also comprises, on each side with respect to the direction of extension of the carrying cables 10, a pair of coaxial support rollers 710. The two pairs of rollers 710 are therefore mounted on the same axis of rotation 715, arranged at the end of the cradle 70 vertically opposite to the point for fixing to the carrying cables 10. The support rollers 710 are able to receive by means of gravity, alternatively, the outward haulage cable 50 or the lifting cable 40. The cradle 70 also comprises, on each side with respect to the direction of extension of the carrying cables 10, a pendulum member 750 which at one end is hinged with a respective shaft 751 arranged in the vicinity of the points for fixing to the carrying cables 10. At the free bottom end the pendulum member 750 is provided, on opposite sides with respect to its thickness, with a pair of retaining rollers 760, which are arranged vertically aligned with the corresponding support rollers 710. The two pendulum members 750 are hinged at longitudinally staggered points of the frame 701 and are connected together by an extension spring 770, so as to define together a pantograph configuration. The retaining rollers 760 are able to bias the lifting cable 40 and haulage cable 50 against the corresponding support rollers 710, so as to prevent these cables from coming out of the support rollers 710. The configuration where the cables are biased against the support rollers 710, represented by means of a continuous line in FIG. 6, is assumed by the cradles 70 in their normal condition, namely when the carriage 20 is situated outside of the positions occupied by them.

Each pendulum member 750 also has a tappet member 770 integral therewith. In the example shown, the tappet member 770 consists of a roller wheel arranged coaxially with the retaining rollers 760. Preferably, this roller wheel is arranged between the two retaining rollers 760 of each pair. The lateral position of the tappet roller wheels 770 is such that they are vertically aligned with the cam members 550 when the carriage 20 starts to engage with the single cradle 70 and during the entire movement of the cradle through the carriage 20. The curved ends 551 of the cam members are shaped so as to define a receiving surface for the tappet roller wheels 770 arranged in the normal condition of the cradle 70. When the cradle 20 starts to engage with a cradle 70, namely upon entry of the longitudinal passage, the cam members 550 engage with the tappet roller wheels 770 of the pendulum members 750 of the cradle 70, causing raising thereof. This raising movement causes, against the recall force of the spring 770, widening of the pantograph configuration formed by the pendulum members 750, and raising of the retaining rollers 760 from the respective support rollers 710. The configuration where the retaining rollers 760 are raised is shown by means of a dot-dash line in FIG. 6. This configuration allows disengagement of the lifting cable 40 and the outward haulage cable 50 from the support rollers 710 when the carriage 20 is passed through by the cradle 70, since, at the entry to the longitudinal passage of the carriage 20, the bearing points for these cables, namely the pulleys 301*b* and the bearing rollers 501*c*, 501*d*, are arranged at a level which is higher than that of the support rollers 710. This is visible in FIGS. 4 and 5, where the cradle 70 is also shown passing through the carriage 20. In order to facilitate comparison, in these figures the cradle is shown both in the normal condition and in the position where it passes through the carriage 20 (position shown in broken lines in the figures).

Since the cam members 550 extend in the form of a rail inside the passage of the carriage 20, they keep the retaining rollers 760 raised. In this way the carriage 20 is able to pass beyond the cradle 70 without knocks or other contact between the parts of the carriage 20 and the cradle 70.

When the carriage 20 passes through the cradle 70, the positions of the haulage cable 50 and lifting cable 40 on the cradles 70 are reversed. As can be seen in FIG. 3, inside the cradle 70 shown on the right the outward haulage cable 50, or more precisely its two sections 51 and 52, rest on a pair of support rollers 710 on one side of the cradle 70, while the lifting cable 40 rests on one of the rollers of the pair of support rollers 710 on the other side of the cradle 70. In the cradle 70 shown on the left-hand side, which may be considered in a condition prior to or after the passage of the carriage 20 depending on the direction of movement of the latter, the positions of the haulage cable 50 and lifting cable 40 on the cradles 70 are clearly reversed. In FIG. 3 it can be seen also that, owing to the deviation pulley 501*b*, the two sections 51 and 52 of the outward haulage cable 50 are situated at a distance from each other equal to the distance between the support rollers 710 of each pair of rollers so that, when the carriage 20 passes through the cradle 70, these sections 51 and 52 remain always at the same distance.

The frame 701 of each cradle 70 also comprises, at its bottom end, a cylindrical lug 780 which, when the carriage 20 passes around the cradle 70, is intended to be received by a central guide 781 installed on the carriage 20 and extending longitudinally. This guide 781 at its ends widens out, in a direction away from the carriage 20, defining respective receiving surfaces for the cylindrical lug 780 of the cradle 70. The function of this feature is to ensure that the cradle 70 is engaged correctly by the passing movement of the carriage 20, correcting any small transverse inclinations.

The particular forms of the cradles and the carriage may obviously be varied, as may also the relative positions of the cables.

What is essential is that the cradles should be fixed to the carrying cables without creating any obstacle to the movement of the carriage and that the points where the cables are applied to the entrance of the carriage should be at a higher level than the support members supported by the cradle. In this way any contact between the carriage and the cradles may be avoided. These may come into contact with each other only at the respective points where they are mounted on the carrying cables and in the region of the cam members and the respective tappet members.

The lifting cable may also follow any desired path in the carriage, provided that this cable does not create any obstacle in the longitudinal passage formed for allowing the cradles to pass through.

I claim:

1. A blondin cableway installation, comprising at least one carrying cable extending between the two ends of the installation, a carriage provided with a lifting tackle and supported movably on said carrying cable, a lifting cable for operating said lifting tackle, extending between the two ends of the installation, an outward haulage cable for conveying said carriage along said carrying cable, said outward haulage cable being connected via tackle to said carriage so as to have a pair of outward haulage sections which extend between said carriage and each end of the installation, and a plurality of cradles arranged along said carrying cable and suspended from it in a stationary manner and designed to support said lifting cable and outward haulage cable, each of said cradles comprising, on each side, a pair of support rollers able to receive by means of gravity, alternately, said outward haulage cable or said lifting cable, and a corresponding pair of retaining rollers able to bias said lifting cable and haulage cable against said support rollers, said retaining rollers being supported by a pendulum member hinged with the cradle, wherein said carriage has, formed in it, a longitudinal passage which has a cross-section such as to allow it to be passed through by one of the cradles during the movement of the carriage, and wherein said carriage is provided, on each side of the passage, with a cam member able to raise said retaining rollers upon entry of said passage by the cradle, so as to allow disengagement of said lifting cable and outward haulage cable from said support rollers when the carriage is passed through by the cradle, said cam member acting on a respective tappet member integral with said pendulum member.

2. An installation according to claim 1, in which, at each longitudinal end of the carriage, said haulage cable is wound around a respective transmission pulley, mounted idle on the carriage, wherein said transmission pulleys at the opposite longitudinal ends of the carriage are arranged on opposite sides of the carriage.

3. An installation according to claim 2, in which the rollers of each said pair of support rollers are coaxial and each transmission pulley also has, associated with it, a deviation pulley for deviating one of the outward haulage sections so that the outward haulage sections are at a predetermined mutual distance equal to the distance between the rollers of said pair of support rollers.

4. An installation according to claim 1, in which the rollers of each said pair of retaining rollers are coaxial and each said tappet member includes a tappet roller wheel arranged coaxially with its respective retaining rollers.

5. An installation according to claim 4, in which each said tappet roller wheel is arranged between the two rollers of its respective pair of retaining rollers.

* * * * *